US007432891B2

(12) United States Patent
Fruehauf

(10) Patent No.: US 7,432,891 B2
(45) Date of Patent: Oct. 7, 2008

(54) ACTIVE MATRIX DRIVE CIRCUIT

(75) Inventor: Norbert Fruehauf, Sindelfingen (DE)

(73) Assignee: Universitaet Stuttgart, Stuttgart (DE)

( * ) Notice: Subject to any disclaimer, the term of this patent is extended or adjusted under 35 U.S.C. 154(b) by 624 days.

(21) Appl. No.: 10/689,352

(22) Filed: Oct. 20, 2003

(65) Prior Publication Data

US 2004/0100430 A1 May 27, 2004

(30) Foreign Application Priority Data

Nov. 22, 2002 (DE) ..... 102 54 511

(51) Int. Cl.
*G09G 3/32* (2006.01)

(52) U.S. Cl. ..... 345/82

(58) Field of Classification Search ..... 345/30–111
See application file for complete search history.

(56) References Cited

U.S. PATENT DOCUMENTS

| | | | | |
|---|---|---|---|---|
| 5,451,978 | A * | 9/1995 | Harju | 345/78 |
| 6,356,029 | B1 * | 3/2002 | Hunter | 315/169.1 |
| 6,466,188 | B1 * | 10/2002 | Cato | 345/82 |
| 2002/0030647 | A1 | 3/2002 | Hack et al. | |
| 2002/0101172 | A1 | 8/2002 | Bu | |
| 2002/0101395 | A1 | 8/2002 | Inukai | |
| 2002/0140659 | A1 | 10/2002 | Mikami et al. | |

FOREIGN PATENT DOCUMENTS

| | | | |
|---|---|---|---|
| DE | 43 15 819 | A1 | 11/1993 |
| DE | 100 09 204 | A1 | 8/2001 |
| JP | 2002091377 | | 3/2002 |

OTHER PUBLICATIONS

Akira Yumoto: "Pixel-Driving Methods for Large-Sized Poly-Si . . . " Asia Display/IDW' 01, pp. 1395-1398, 2001.

* cited by examiner

*Primary Examiner*—Sumati Lefkowitz
*Assistant Examiner*—Srilakshmi K Kumar
(74) *Attorney, Agent, or Firm*—Michael J. Striker

(57) ABSTRACT

A driving circuit for an image point of an image screen which has an organic light-emitting diode includes a capacitor, a feedback coupling, a first thin film transistor as a current-driving transistor for the diode, a second transistor which is connected by a current-conducting electrode with a gate of the first transistor and by a second current-conducting electrode with a data conductor and by its gate electrode with a scanning signal conductor, a third thin film transistor which during driving its gate through a driving conductor taps a diode driving current and an output of the first transistor and supplies a current measuring- and voltage regulating circuit, the current measuring- and voltage regulating circuit providing to the data conductor a voltage signal which is dependent on a current measuring result and a voltage comparison, so that the diode during driving of the gate of the third transistor due to its non-linear switching characteristic acts as a switch for a current deviation in the current measuring- and voltage regulating circuit.

3 Claims, 1 Drawing Sheet

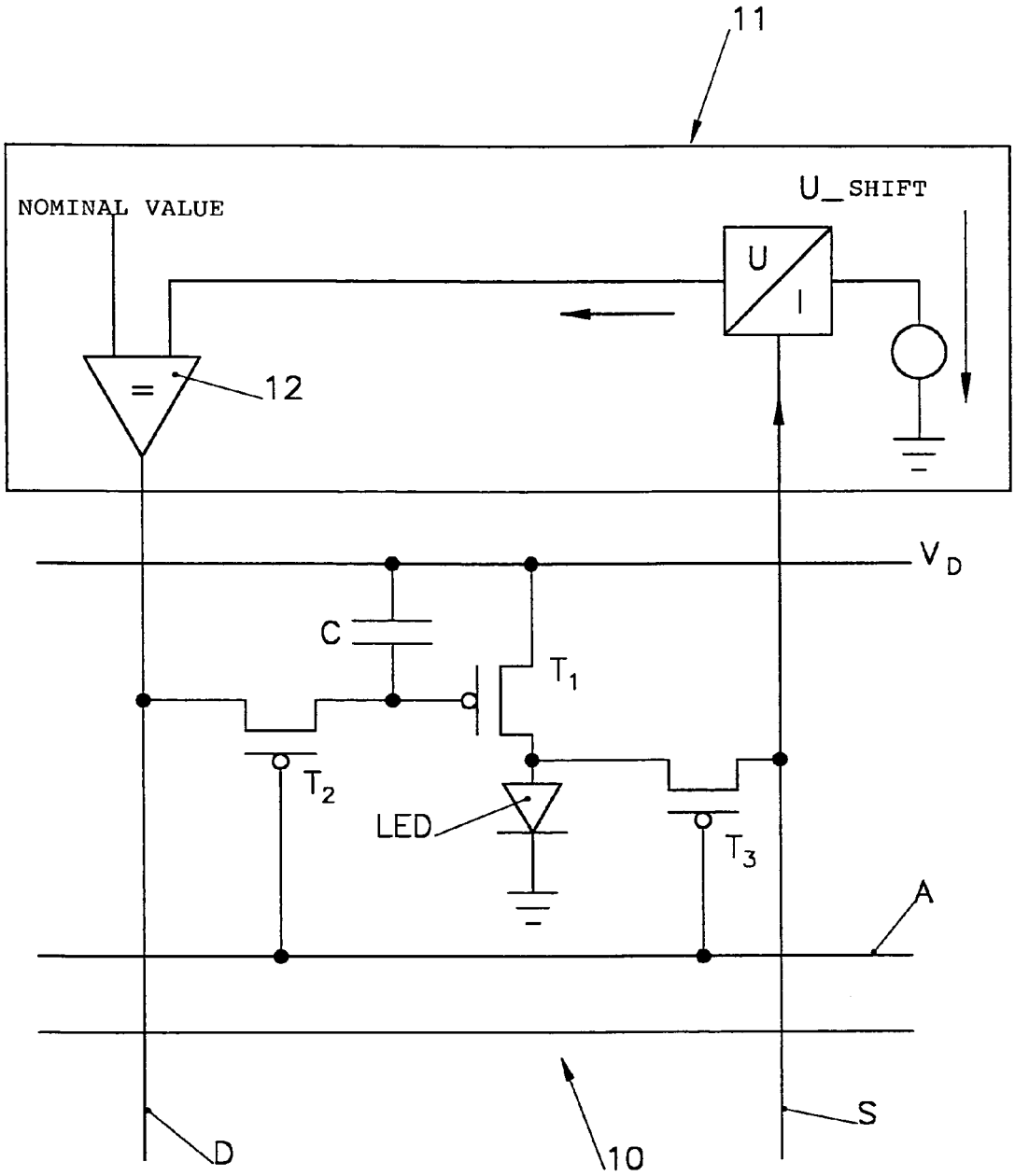
11
NOMINAL VALUE
U_SHIFT
U
I
=
12
$V_D$
C
$T_1$
$T_2$
LED
$T_3$
A
D
10
S

ACTIVE MATRIX DRIVE CIRCUIT

BACKGROUND OF THE INVENTION

The present invention relates to a drive circuit for an image point of an image screen, which has in particular an organic light-emitting diode, with a capacitor and a current feedback, wherein a first thin film transistor is provided as the current driving transistor for the diode, and a second thin film transistor is connected with a current-conducting electrode with a gate of the first transistor and with a second current-conducting electrode with a data conductor and with its gate electrode with a scanning signal conductor.

In the driving of image screens with light-emitting diodes (LED), in particular organic, light-emitting diodes (OLED) via thin film transistors, spacial fluctuations of the LED driver currents occur because of manufacturing-dependent fluctuations of the parameters of the thin film transistors, in particular the threshold voltage and the charge carrier movement. Thereby disturbing spacial inhomogenuities of the image screen light density are caused.

In order to solve this problem, various compensation features for the driver current fluctuations of the LED are proposed. A. Yumoto, et al discloses in "Pixel-Driving Methods of Large-Sized Poly-Si AM-OLED displays", Asia Display/IDW'01, pages 1395-1398, 2001 the driving circuits typically with at least four thin film transistors for compensation of the fluctuations of the driving currents. These circuits provide however only a partial compensation and therefore, with a great number of transistors, produced a relatively low manufacturing yield.

U.S. patent application U.S. 2002/0101172 A1 discloses a driving circuit which additionally has further thin film transistors for supplying the LED current back to an external current-voltage conversion circuit and therefore allowing a feedback of the actual flowing current.

The known voltage-control solutions allow however the compensation of the threshold voltage fluctuations, but not also the compensation of fluctuations of the charge carrier movement. The current-controlled solutions are very high-ohmic and require relatively long response times. With the use of pure current mirror circuits, two thin filmed transistors must have approximately identical properties, that is difficult to implement for thin filmed transistors.

A further disadvantage of the known, above described current feedback circuit is that parts of the drive circuit must be realized at both sides of the LED element, that requires a technically extremely difficult-to-produce through contacting with the LED semiconductor material; in particular with organic semiconductor materials. Moreover, the known circuit is expensive since four additional thin filmed transistors are required, including two thin film transistors which act as switches and two thin film transistors for an invertor.

SUMMARY OF THE INVENTOR

Accordingly, it is an object of the present invention to provide an active matrix drive circuit which avoids the disadvantages of the prior art.

More particularly, it is an object of the present invention to provide an active matrix drive circuit with a current feedback, which requires less components and is simpler to manufacture than the known circuits.

In keeping with these objects and with others which will become hereinafter, one feature of the present invention resides, briefly stated, in a driving circuit of the above mentioned general type, in which a third transistor is provided, which by driving its gate through a driving conductor taps the diode driving current at the output of the current-driving transistor and supplies a current measuring and voltage regulating circuit, and the current measuring-space and voltage regulating circuit provides to the data conductor a voltage signal which is dependent on current measurement results and a voltage comparison, wherein the driving of the gate of the third transistor acts due to its non-linear switching characteristic as a switch for a current deviation in the current measuring- and voltage regulating circuit.

With this circuit the current to be measured is directly tapped at the output of the current-driving thin film transistor. The measured value of the current is compared with a nominal value, and in the case of deviation of the value a corresponding correcting signal is provided at the input of the image point circuit. Thereby after switching off of the third transistor, the driving current flowing through the LED is stabilized.

The inventive circuit can be thereby always used when sufficiently homogenous LED parameter is provided. The inventive circuit has moreover the advantage that despite an additional thin film transistor, totally only three thin film transistors are required, since the non-linear LED characteristic is used for switching off of the current through the LED element. In other words, no separate switch must be provided for the current. This also makes possible the realization of all circuit parts at one side of the LED element, so that a conventional layer sequence can be used during the manufacture. A through contacting through the LED material, in particular through the organic material with an organic LED, is not necessary.

The gate electrode of the third transistor can be connected with the scanning signal conductor, so that the third transistor is activated together with the second transistor, when the image point is selected. This saves the otherwise required additional driving conductor.

Further advantages are provided in accordance with the present invention when the components of the current measuring- and voltage regulating circuit connected with the split conductors are low-ohmic, so that total very short response times are provided.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

The single FIGURE of the drawings is a view showing a drive circuit in accordance with the present invention.

DESCRIPTION OF THE PREFERRED EMBODIMENTS

The single FIGURE of the drawings is a view showing a switching diagram of a typical drive circuit in accordance with the present invention, with P-channel-TFTs (T1, T2) for an image point 10 of a display. Naturally, also corresponding layouts with N-channel-TFTs or CMOS implementations are possible. The image point 10 has an organic, light-emitting diode LED with a cathode connected to ground.

A first thin film transistor T1 acts as a current-driving transistor for the LED element. The transistor T1 is driven by a second thin film transistor T2. The second thin film transistor T2 is connected with its drain-terminal with a data conductor D and with its source-terminal with the gate of the first thin film transistor T1. The gate of the second thin film transistor T2 is connected with a scanning signal conductor A. Moreover, the driving circuit has a first capacitor C. It is arranged between the supply voltage VD and the gate of the current driving transistor T1 and serves as a storage element. For current feedback, the circuit has a third film transistor T3. During driving of its gate, it taps the driving current of the LED element directly at the source electrode of the thin film transistor T1 and supplies it to a current measuring- and voltage regulating circuit 11.

The gate of the transistor T3 in the shown embodiment is also connected with the scanning signal conductor A, as the gate of the transistor T2. However, it can be controlled by a separate drive conductor. Depending on the measured current and the comparison of the measuring value with a nominal value in a comparitor 12, the current measuring- and voltage regulating circuit 11 produces a corresponding voltage signal at the data conduit D. Thereby the drive current can be regulated by the resistor T1 to the desired value.

For current deviation in the current measuring- and voltage regulating circuit 11, the non-linear switching characteristic of the LED element is used in connection with a suitable, adjustable anode potential of the LED element, through the voltage source U shift. The image point-circuit comes out with all three transistors T1, T2, T3.

The components which are connected to the split conduits D and S of the image point 10, the comparitor 12 as a voltage source circuit and the current measuring circuit at the conductor S, are both low-ohmic. Therefore, response times are very short, in contrast to typical current-addressing solutions.

It will be understood that each of the elements described above, or two or more together, may also find a useful application in other types of constructions differing from the types described above.

While the invention has been illustrated and described as embodied in active matrix drive circuit, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

The invention claimed as new and desired to be protected by letters patent is set forth in the appenede claims:

1. A driving circuit for an image point of an image screen which has an organic light-emitting diode, comprising a capacitor; a feedback coupling; a first thin film transistor as a current-driving transistor for the diode; a second transistor which is connected by a current-conducting electrode with a gate of said first transistor and by a second current-conducting electrode with a data conductor and by its gate electrode with a scanning signal conductor; a third thin film transistor which during driving its gate through a driving conductor taps a diode driving current at an output of said first current-driving transistor and supplies a current measuring- and voltage regulating circuit, said current measuring- and voltage regulating circuit providing to the data conductor a voltage signal which is dependent on a current measuring result and a voltage comparison, so that the diode during driving of said gate of said third transistor due to its non-linear switching characteristic acts as a switch for a current deviation in said current measuring- and voltage regulating circuit.

2. A driving circuit as defined in claim 1, wherein said second and said third transistors have gate electrodes which are both connected with said scanning signal conductor.

3. A driving circuit for an image point of an image screen which has an organic light-emitting diode, comprising a capacitor; a feedback coupling; a first thin film transistor as a current-driving transistor for the diode; a second transistor which is connected by a current-conducting electrode with a gate of said first transistor and by a second current-conducting electrode with a data conductor and by its gate electrode with a scanning signal conductor; a third thin film transistor which during driving its gate through a driving conductor taps a diode driving current at an output of said first current-driving transistor and supplies a current measuring-measuring and voltage regulating circuit, said current measuring- and voltage regulating circuit providing to the data conductor a voltage signal which is dependent on a current measuring result and a voltage comparison, so that the diode during driving of said gate of said third transistor due to its non-linear switching characteristic acts as a switch for a current deviation in said current measuring-and voltage regulating circuit, wherein all above mentioned elements of the driving circuit are located at a same side of said light emitting diode, so that no contacts must be guided through a semiconductor material of the diode.

* * * * *